US012650076B2

(12) United States Patent
Zhou et al.

(10) Patent No.: US 12,650,076 B2
(45) Date of Patent: Jun. 9, 2026

(54) ACTIVE CONTROL METHOD AND DEVICE FOR LARGE DEFORMATION OF DEEP THIN-BEDDED SURROUNDING ROCK

(71) Applicants: Huaneng Lancang River Hydropower Inc, Kunming (CN); POWERCHINA Kunming Engineering Corporation Limited, Kunming (CN); Institute of Rock and Soil Mechanics, Chinese Academy of Sciences, Wuhan (CN)

(72) Inventors: Hua Zhou, Kunming (CN); Yelin Feng, Kunming (CN); Fugang Zhao, Kunming (CN); Pengzhi Pan, Kunming (CN); Hailong Huang, Kunming (CN); Zhaofeng Wang, Kunming (CN); Xufeng Liu, Kunming (CN); Yangyi Zhou, Kunming (CN); Longhai Xi, Kunming (CN); Xuanjiao Zhen, Kunming (CN)

(73) Assignees: Huaneng Lancang River Hydropower Inc, Kunming (CN); POWERCHINA Kunming Engineering Corporation Limited, Kunming (CN); Institute of Rock and Soil Mechanics, Chinese Academy of Sciences, Wuhan (CN)

( * ) Notice: Subject to any disclaimer, the term of this patent is extended or adjusted under 35 U.S.C. 154(b) by 382 days.

(21) Appl. No.: 18/497,843

(22) Filed: Oct. 30, 2023

(65) Prior Publication Data

US 2024/0141786 A1 May 2, 2024

Related U.S. Application Data

(63) Continuation of application No. PCT/CN2023/123485, filed on Oct. 9, 2023.

(30) Foreign Application Priority Data

Oct. 29, 2022 (CN) ..... 202211339376.6

(51) Int. Cl.
*E21D 20/02* (2006.01)
*E21D 21/00* (2006.01)

(52) U.S. Cl.
CPC ..... *E21D 20/028* (2013.01); *E21D 20/025* (2013.01); *E21D 21/0026* (2013.01)

(58) Field of Classification Search
CPC ..... E21D 20/028; E21D 20/025; E21D 21/0026; E21D 20/02; E21D 20/021; E21D 21/008; E21D 20/003
See application file for complete search history.

(56) References Cited

FOREIGN PATENT DOCUMENTS

AU 2010291863 A1 * 3/2012 ..... E21D 21/008
CA 3078950 A1 * 10/2020 ..... E21D 21/008

* cited by examiner

*Primary Examiner* — Janine M Kreck

(57) ABSTRACT

An active control method and device for large deformation of a deep thin-bedded surrounding rock, the active control method includes: drill holes in the surrounding rock of a tunnel against a tunnel face, add the active control device containing a sleeve, a high-strength prestressed anchor bolt, a resin anchoring agent and a grouting device into drill holes, apply a preload to the anchor bolt when the resin anchoring agent has a certain strength, and carry out lag grouting in the surrounding rock through the grouting device after stress adjustment, and the high-strength prestressed anchor bolt and the grouting device are inserted in the sleeve with holes on the side. The active control device or method of the invention can effectively reduce the fracture depth and degree of a thin-bedded soft rock in deep engineering, and effectively inhibit the occurrence of large deformation disasters.

9 Claims, 1 Drawing Sheet

ACTIVE CONTROL METHOD AND DEVICE FOR LARGE DEFORMATION OF DEEP THIN-BEDDED SURROUNDING ROCK

CROSS-REFERENCE TO RELATED APPLICATIONS

This application is a continuation of PCT/CN2023/123485, filed Oct. 9, 2023 and claims priority of Chinese Patent Application No. 202211339376.6, filed on Oct. 29, 2022, the entire contents of which are incorporated herein by reference.

TECHNICAL FIELD

The invention relates to the technical field of geotechnical engineering, in particular to the technical field of a large deformation control method for surrounding rocks.

BACKGROUND ART

For the deep thin-bedded rock mass engineering, the surrounding rocks will be broken within a wide range in a short time due to the high geostress stress level after tunnel excavation, forming a m-class large deformation disaster, seriously damaging the support structure, threatening the safety of construction personnel, affecting the project progress and causing large economic losses.

As an efficient support method, the anchor bolt support has been widely used in the field of surrounding rock support. However, the following situations may occur on the common grouted anchor bolt in the control practice of the deep thin-bedded surrounding rock: the surrounding rock will be broken within a wide range due to the untimely application of the anchoring force, the anchor bolt will be pulled off due to the large deformation of the surrounding rock, the bolt will be sheared due to the shear slip of the surrounding rock along the layer, and the rock mass will continue to crack due to the long adjustment time of the surrounding rock stress. To solve the above problems, it is necessary to develop a new active control method and device for the large deformation of the deep thin-bedded surrounding rock.

CONTENT OF INVENTION

Aiming at the problems such as poor timeliness of support means, easy pulling or shearing of anchor bolt and poor integrity of surrounding rock after stress adjustment in the large deformation control of the deep thin-bedded surrounding rock for the high stress tunnel in the prior art, the invention aims to propose a new active control method and device for the large deformation of a deep thin-bedded surrounding rock.

The invention adopts the following technical proposal:

An active control device for large deformation of a deep thin-bedded surrounding rock comprises a sleeve with holes on two sides, a high-strength prestressed anchor bolt inserted in the sleeve and extended outside the sleeve, and a grouting device arranged side by side with the anchor bolt and capable of grouting; the high-strength prestressed anchor bolt is provided with a reverse anti-skid device and a resin anchoring agent filling section located at the front end of the reverse anti-skid device and between the high-strength prestressed anchor bolt and the sleeve and formed by the applied resin anchoring agent by extending into the tail end of the deep thin-bedded surrounding rock through the construction hole, wherein the reverse anti-skid device is a conical fastener that can be fixed at the tail end of the high-strength prestressed anchor bolt; a decoupling structure is wound in the middle section of the high-strength prestressed anchor bolt and is formed by winding a geomembrane onto the middle section of the high-strength prestressed anchor bolt; a cotton yarn filling section formed by cotton yarns surrounding the high-strength prestressed anchor bolt, and a tray and a fastener located outside the sleeve are arranged successively at the head end of the high-strength prestressed anchor bolt, wherein the tray can limit the part of the high-strength prestressed anchor bolt extending out of the sleeve to the outer surface of the surrounding rock and fix the part by fit with the fastener; the grouting device can be extended into the sleeve after passing through the tray.

According to some embodiments of the invention, an aligning ball seat is also arranged between the tray and the fastener, and the grouting device can be extended into the sleeve after passing through the aligning ball seat and the tray.

According to some embodiments of the invention, the tail end of the high-strength prestressed anchor bolt is fixed with the reverse anti-skid device through a threaded connection.

According to some embodiments of the invention, the high-strength prestressed anchor bolt can withstand a preload more than 100 kN.

According to some embodiments of the invention, the sleeve is made of a steel pipe.

According to some embodiments of the invention, the grouting device comprises a grouting pipe inserted into the sleeve side by side with the high-strength prestressed anchor bolt and used for slurry conveying, and a valve arranged at the head end of the grouting pipe and used for regulating the slurry flow; a plurality of jet holes used for discharging the slurry into the sleeve are arranged at the tail end of the grouting pipe.

According to some embodiments of the invention, the total length of the grouting pipe is 20 to 30 cm more than that of the high-strength prestressed anchor bolt, and the tail end thereof is located before the resin anchoring agent filling section.

The invention further discloses an active control method for the large deformation of a deep thin-bedded surrounding rock using the active control device for the large deformation of the deep thin-bedded surrounding rock includes:

- Step 1: Drill holes in the surrounding rock of the tunnel against the tunnel face after rock mass excavation;
- Step 2: Install the reverse anti-skid device at the tail end of the high-strength prestressed anchor bolt, and install the resin anchoring agent, the decoupling structure, the sleeve and the cotton yarn in turn, and then insert into the construction drill hole;
- Step 3: Install the tray, the fastener and the grouting device successively at the head end of the high-strength prestressed anchor bolt when the resin anchoring agent sets and has a certain strength;
- Step 4: Apply a preload force of 100 to 200 kN to the high-strength prestressed anchor bolt after completing Step 3;
- Step 5: After adjusting the stress of the surrounding rock, grout into the sleeve through the grouting device, and the slurry enters the surrounding rock from the holes of the sleeve to realize the grouting reinforcement of the surrounding rock.

The invention has the following beneficial effects:

(1) The control device of the invention adopts the method of high-strength anchor bolt prestress combined with the resin anchoring agent, which can apply high prestress in a short time after the installation of the anchor bolt, quickly play a role of anchoring, enhance the timeliness of the bolt support, reduce the rupture caused by the strong unloading of the rock mass excavation at the high geostress, and restore the real three-dimensional stress state of the surrounding rock.

(2) The control device of the invention can carry out the lag grouting if the surrounding rock is locally damaged and broken due to stress adjustment in the later stage, further reinforce the surrounding rock after the construction of the anchor bolt, block the cracks of the surrounding rock, and remold the integrity of the surrounding rock to improve the strength of the surrounding rock.

(3) The control device of the invention is provided with a decoupling structure, which can separate the anchor bolt body from the bolt-grouting body through Poisson effect after the surrounding rock has a large deformation, thereby preventing the anchor bolt from being pulled off due to excessive local deformation.

(4) The control device of the invention is provided with a sleeve, which can reduce the concentration degree of shear stress on the anchor bolt and reduce the probability of the anchor bolt being sheared when the surrounding rock slips along the bedding.

(5) The control method or device of the invention is simple and reasonable, reduces the cost of drilling for late grouting, realizes dual purposes of a hole, and has significant economic benefits.

(6) The control method of the invention attaches importance to the timeliness of large deformation control of thin-bedded surrounding rock for the high-stress tunnel, the support measures used can play an active support role immediately after the excavation of the rock mass to restore the real three-dimensional stress condition of the surrounding rock and increase the self-supporting capability of the surrounding rock as much as possible, and the anchor bolt used in the later stress adjustment process of the surrounding rock can adapt to the deformation of the rock mass, so that the anchor bolt cannot be pulled off or sheared, and the lag grouting can be carried out for reinforcing the surrounding rock damaged and broken due to stress adjustment.

EMBODIMENTS

Figure 1:
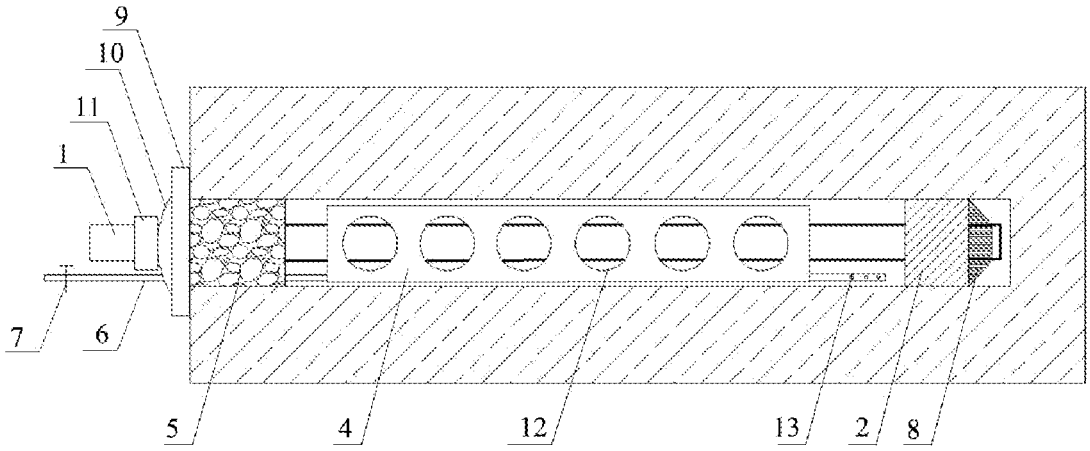
FIG. 1 is the structure diagram for the application of high-strength prestressed lag grouting anchor bolt in the embodiment of the invention.

The invention is described in detail in combination with embodiments and the drawings. However, it should be understood that the embodiments and the drawings are only used for an exemplary description of the invention and do not constitute any limitation to the scope of protection of the invention. All reasonable transformations and combinations contained within the scope of purpose of the invention fall within the scope of protection of the invention.

Step 1: Drill holes in the surrounding rock of the tunnel against the tunnel face of after the rock mass excavation;

Step 2: Install high-strength prestressed anchor members;

Step 3: Apply a preload to the anchor bolt after the resin anchoring agent has a certain strength;

Step 4: Carry out lag grouting in the surrounding rock after the stress adjustment.

Further, the high-strength prestressed anchor member comprises a high-strength prestressed anchor bolt (1), a resin anchoring agent (2), a decoupling structure (3), a sleeve (4), cotton yarns (5), a lag grouting device, a reverse anti-slip device (8), a tray (9), an aligning ball seat (10) and a nut (11); threads are machined at both ends of the high prestressed anchor bolt, the specification of the anchor bolt are matched with the reverse anti-slip device, the nut, the aligning ball seat and the tray, the nut, the aligning ball seat and the tray are installed at the head end of the anchor bolt, the reverse anti-slip device is installed at the tail end thereof, and the decoupling structure is wound in the middle of the anchor bolt body; the anchor bolt is inserted in the sleeve, and the lag grouting device is arranged side by side with the anchor bolt in the drill hole.

Further, the preload of the high-strength prestressed anchor bolt is more than 100 kN.

Further, the decoupling structure is made of flexible woodworking membrane with strong elasticity and is evenly wound around the anchor bolt body.

Further, the sleeve is cut from a steel pipe, and holes (12) are drilled on both sides of the sleeve.

Further, the lag grouting device comprises a grouting pipe (6) and a valve (7), the valve is installed at the head end of the grouting pipe, and 3 to 5 jet holes (13) are drilled at the tail end of the grouting pipe, and the length of the grouting pipe is 20 to 30 cm more than that of the anchor bolt.

Further, a hole is drilled on the tray, and the diameter thereof is more than that of the grouting pipe.

Embodiment 1

Figure 2:
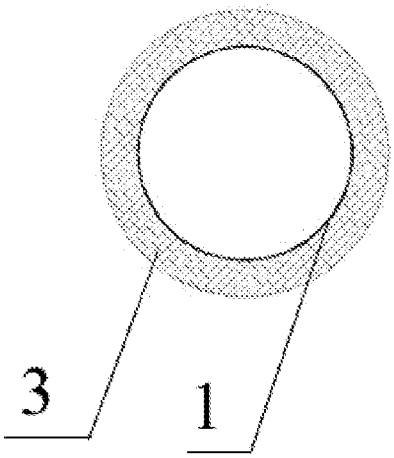
FIG. 2 is the structural layout diagram of the decoupling structure in the embodiment of the invention.

The active control device for the large deformation uses the high-strength prestressed lag grouting anchor bolt shown in FIG. 1 and FIG. 2, which comprises:

A sleeve 4 with holes 12 on both sides, a high-strength prestressed anchor bolt 1 inserted in the sleeve and extended outside the sleeve 4, and a grouting device arranged side by side with the anchor bolt land capable of grouting; the high-strength prestressed anchor bolt 1 is provided with a reverse anti-skid device 8 and a resin anchoring agent filling section 2 located at the front end of the reverse anti-skid device and between the high-strength prestressed anchor bolt and the sleeve and formed by the applied resin anchoring agent by extending into the tail end of the deep thin-bedded surrounding rock through the construction hole, wherein the reverse anti-skid device 8 is a conical fastener that can be fixed at the tail end of the high-strength prestressed anchor bolt, such as a conical nut; a decoupling structure 3 is wound in the middle section of the high-strength prestressed anchor bolt 1 and is formed by winding a geomembrane onto the middle section of the high-strength prestressed anchor bolt 1; a cotton yarn filling section 5 formed by cotton yarns surrounding the high-strength prestressed anchor bolt 1, and a tray 9, an aligning ball seat 10 and a nut 11 located outside the sleeve are arranged successively at the head end of the high-strength prestressed anchor bolt 1, wherein the tray 9 can limit the part of the high-strength prestressed anchor bolt extending out of the sleeve 4 to the outer surface of the surrounding rock and fix the part by fit with the aligning ball seat 10 and the nut 11; the grouting device can be extended into the sleeve after passing through the aligning ball seat 10 and the tray 9.

Preferably, the tail end of the high-strength prestressed anchor bolt 1 is fixed with the reverse anti-skid device 8 through a threaded connection.

Embodiment 2

In the high-strength prestressed lag grouting anchor bolt of the embodiment 1, the preload of the high-strength prestressed anchor bolt 1 is more than 100 kN, and the sleeve is made of a steel pipe.

Embodiment 3

In the high-strength prestressed lag grouting anchor bolt of the embodiment 1, the grouting device comprises a grouting pipe 6 inserted into the sleeve side by side with the high-strength prestressed anchor bolt 1 and used for slurry conveying, and a valve 7 arranged at the head end of the grouting pipe and used for regulating the slurry flow, and 3 to 5 jet holes used for discharging the slurry from the grouting pipe 6 into the sleeve are arranged at the tail end of the grouting pipe 6.

Preferably, the total length of the grouting pipe 6 is 20 to 30 cm more than that of the high-strength prestressed anchor bolt 1, and the tail end thereof is located before the resin anchoring agent filling section 2.

Preferably, a hole is drilled on the tray 9, the diameter thereof is more than that of the grouting pipe 6, and the grouting pipe 6 is extended into the sleeve 4 through the hole.

Embodiment 4

A high-strength prestressed lag grouting anchor bolt in any of the embodiments 1-3 performs the active control for the large deformation of the deep thin-bedded surrounding rock mass, including the following steps:

Step 1: Drill holes in the surrounding rock of the tunnel against the tunnel face after rock mass excavation;

Step 2: Install the reverse anti-skid device 8 at the end of the high-strength prestressed anchor bolt 1, and install the resin anchoring agent, the decoupling structure 3, the sleeve 4 and the cotton yarn in turn, and then insert into the drill hole;

Step 3: Install the tray, the aligning ball seat, the nut and the grouting device successively at the head end of the high-strength prestressed anchor bolt 1 when the resin anchoring agent sets and has a certain strength;

Step 4: Apply a preload of 100 to 200 kN to the high-strength prestressed anchor bolt 1 after installing the high-strength prestressed lag grouting anchor bolt;

Step 5: After adjusting the stress of the surrounding rock, grout into the sleeve 4 through the grouting device, and the slurry enters the surrounding rock from the holes 12 of the sleeve 4 to realize the grouting reinforcement of the surrounding rock.

The above embodiments are only the preferred embodiments of the invention, and the scope of protection of the invention is not limited to the above embodiments. All technical proposals conforming to the ideas of the invention fall within the scope of protection of the invention. It should be noted that any improvements and refinements made by ordinary technicians in the technical field without deviation from the principle of the invention should be considered to fall within the scope of protection of the invention.

The invention claimed is:

1. An active control device for large deformation of a deep thin-bedded surrounding rock, characterized by comprising a sleeve with holes on two sides, a high-strength prestressed anchor bolt inserted in the sleeve and extended outside the sleeve, and a grouting device arranged side by side with the anchor bolt and capable of grouting; the high-strength prestressed anchor bolt is provided with a reverse anti-skid device and a resin anchoring agent filling section located at the front end of the reverse anti-skid device and between the high-strength prestressed anchor bolt and the sleeve and formed by the applied resin anchoring agent by extending into a tail end of the deep thin-bedded surrounding rock through the construction hole, wherein the reverse anti-skid device is a conical fastener that can be fixed at the tail end of the high-strength prestressed anchor bolt; a decoupling structure is wound in the middle section of the high-strength prestressed anchor bolt and is formed by winding a geomembrane onto the middle section of the high-strength prestressed anchor bolt; a cotton yarn filling section formed by cotton yarns surrounding the high-strength prestressed anchor bolt, and a tray and a fastener located outside the sleeve are arranged successively at the head end of the high-strength prestressed anchor bolt, wherein the tray can limit the part of the high-strength prestressed anchor bolt extending out of the sleeve to the outer surface of the surrounding rock and fix the part by fit with the fastener; the grouting device can be extended into the sleeve after passing through the tray.

2. The active control device for the large deformation of the deep thin-bedded surrounding rock according to claim 1, characterized in that an aligning ball seat is also arranged between the tray and the fastener, and the grouting device can be extended into the sleeve after passing through the aligning ball seat and the tray.

3. The active control device for the large deformation of the deep thin-bedded surrounding rock according to claim 1, characterized in that the tail end of the high-strength prestressed anchor bolt is fixed with the reverse anti-skid device through a threaded connection.

4. The active control device for the large deformation of the deep thin-bedded surrounding rock according to claim 1, characterized in that the high-strength prestressed anchor bolt can withstand a preload more than 100 kN.

5. The active control device for the large deformation of the deep thin-bedded surrounding rock according to claim 1, characterized in that the sleeve is made of a steel pipe.

6. The active control device for the large deformation of the deep thin-bedded surrounding rock according to claim 1, characterized in that the grouting device comprises a grouting pipe inserted into the sleeve side by side with the high-strength prestressed anchor bolt and used for slurry conveying, and a valve arranged at the head end of the grouting pipe and used for regulating the slurry flow; a plurality of jet holes used for discharging the slurry into the sleeve are arranged at the tail end of the grouting pipe.

7. The active control device for the large deformation of the deep thin-bedded surrounding rock according to claim 6, characterized in that total length of the grouting pipe is 20 to 30 cm more than that of the high-strength prestressed anchor bolt, and the tail end thereof is located before the resin anchoring agent filling section.

8. An active control method for large deformation of a deep thin-bedded surrounding rock using the active control device for the large deformation of the deep thin-bedded surrounding rock in claim 1, including:

Step 1: Drill holes in the surrounding rock of the tunnel against the tunnel face after rock mass excavation to form at least one construction drill hole;

Step 2: Install the reverse anti-skid device at the tail end of the high-strength prestressed anchor bolt, and install the resin anchoring agent, the decoupling structure, the sleeve and the cotton yarn in turn, and then insert into the construction drill hole;

Step 3: Install the tray, the fastener and the grouting device successively at the head end of the high-strength prestressed anchor bolt when the resin anchoring agent sets and has a certain strength;

Step 4: Apply a preload force of 100 to 200 kN to the high-strength prestressed anchor bolt after completing Step 3;

Step 5: After adjusting the stress of the surrounding rock, grout into the sleeve through the grouting device, and the slurry enters the surrounding rock from the holes of the sleeve to realize the grouting reinforcement of the surrounding rock.

9. An active control method for large deformation of a deep thin-bedded surrounding rock using the active control device for the large deformation of the deep thin-bedded surrounding rock in claim 7, including:

Step 1: Drill holes in the surrounding rock of the tunnel against the tunnel face after rock mass excavation to form at least one construction drill hole;

Step 2: Install the reverse anti-skid device at the tail end of the high-strength prestressed anchor bolt, and install the resin anchoring agent, the decoupling structure, the sleeve and the cotton yarn in turn, and then insert into the construction drill hole;

Step 3: Install the tray, the fastener and the grouting device successively at the head end of the high-strength prestressed anchor bolt when the resin anchoring agent sets and has a certain strength;

Step 4: Apply a preload force of 100 to 200 kN to the high-strength prestressed anchor bolt after completing Step 3;

Step 5: After adjusting the stress of the surrounding rock, grout into the sleeve through the grouting device, and the slurry enters the surrounding rock from the holes of the sleeve to realize the grouting reinforcement of the surrounding rock.

* * * * *